US011496836B1

(12) United States Patent
Mainini et al.

(10) Patent No.: US 11,496,836 B1
(45) Date of Patent: Nov. 8, 2022

(54) HEADSET WITH IMPROVED HEADBAND

(71) Applicant: Plantronics, Inc., Santa Cruz, CA (US)

(72) Inventors: Matthew J. Mainini, Santa Cruz, CA (US); John A. Kelley, Santa Cruz, CA (US); Stann N. Sheperd, Santa Cruz, CA (US)

(73) Assignee: PLANTRONICS, INC., Santa Cruz, CA (US)

( * ) Notice: Subject to any disclaimer, the term of this patent is extended or adjusted under 35 U.S.C. 154(b) by 0 days.

(21) Appl. No.: 17/246,169

(22) Filed: Apr. 30, 2021

(51) Int. Cl.
*H04R 5/033* (2006.01)
*H04R 1/10* (2006.01)

(52) U.S. Cl.
CPC ..... *H04R 5/0335* (2013.01); *H04R 1/1066* (2013.01); *H04R 2201/107* (2013.01)

(58) Field of Classification Search
CPC ..... H04R 5/0335; H04R 1/1066; H04R 2201/107
See application file for complete search history.

(56) References Cited

U.S. PATENT DOCUMENTS 5,574,795 A 11/1996 Seki ..... 381/183
5,619,584 A 4/1997 Lin ..... 381/183
9,980,048 B2 5/2018 Henderson ..... H04R 1/10
2016/0212519 A1* 7/2016 Henderson ..... H04R 5/0335
2020/0053448 A1* 2/2020 Heaston ..... H04R 1/1058

FOREIGN PATENT DOCUMENTS

GB 2275846 A * 9/1994 ..... H04R 5/0335

OTHER PUBLICATIONS

Master & Dynamic—User Manual—MW65 Active Noise-Cancelling Wireless Over-Ear Headphones, 2 pages, Aug. 6, 2019.

* cited by examiner

*Primary Examiner* — Angelica M McKinney
(74) *Attorney, Agent, or Firm* — Slayden Grubert Beard PLLC

(57) ABSTRACT

Headsets with an improved headband are provided. In some embodiments, a headset comprises: a left earphone assembly; a right earphone assembly; and a headband assembly having a left end movably coupled to the left earphone assembly and a right end movably coupled to the right earphone assembly. The headband assembly comprises: an outer headband, extending between the left end and the right end of the headband assembly; a first elongated housing, arranged on an interior side of the outer headband and extending from the left end of the headband assembly to a first housing inner end; a second elongated housing, arranged on the interior side of the outer headband and extending from the right end of the headband assembly to a second housing inner end; and an inner headband, coupled between the first housing inner end and the second housing inner end on an interior side of the outer headband.

20 Claims, 10 Drawing Sheets

HEADSET WITH IMPROVED HEADBAND

FIELD

The present disclosure relates generally to the headsets and headphones.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

Headphones and headsets are ubiquitous today, not only due to the increasing mobility of media consumption on mobile devices, but also in light of an increase in video/audio conferencing and remote work. A typical office worker may spend a significant part of her or his workday using a headset. Furthermore, headsets may be worn in a variety of contexts, including situations where the user is in movement. As such, the inventors have ascertained that comfort, fit, and stability may be considerable design parameters of a headset.

Some headsets utilize a headband which is worn over the user's head. The headband operates to support and position the earphones worn on the user's ears. Since headsets must be capable of being worn by a variety of users having different sized and shaped heads, a headband adjustment mechanism is typically provided. However, in the prior art, these adjustment mechanisms often do not provide the necessary adjustability or comfort to provide a comfortable, secure fit for different users, particularly for long periods of use or during movement, such as when exercising. As a result, improved headsets are needed.

SUMMARY

In general and in one aspect, a headset is provided that comprises a left earphone assembly, a right earphone assembly, and a headband assembly having a left end movably coupled to the left earphone assembly and a right end movably coupled to the right earphone assembly. In the present aspect, the headband assembly comprises an outer headband, extending between the left end and the right end of the headband assembly, a first elongated housing, arranged on an interior facing side of the outer headband and extending from the left end of the headband assembly to a first housing inner end; a second elongated housing, arranged on the interior facing side of the outer headband and extending from the right end of the headband assembly to a second housing inner end; and an inner headband, coupled between the first housing inner end and the second housing inner end on an interior facing side of the outer headband.

The details of one or more embodiments are set forth in the accompanying drawings and the description below. Other features will be apparent from the description, drawings, and from the claims.

DESCRIPTION

Figure 1:
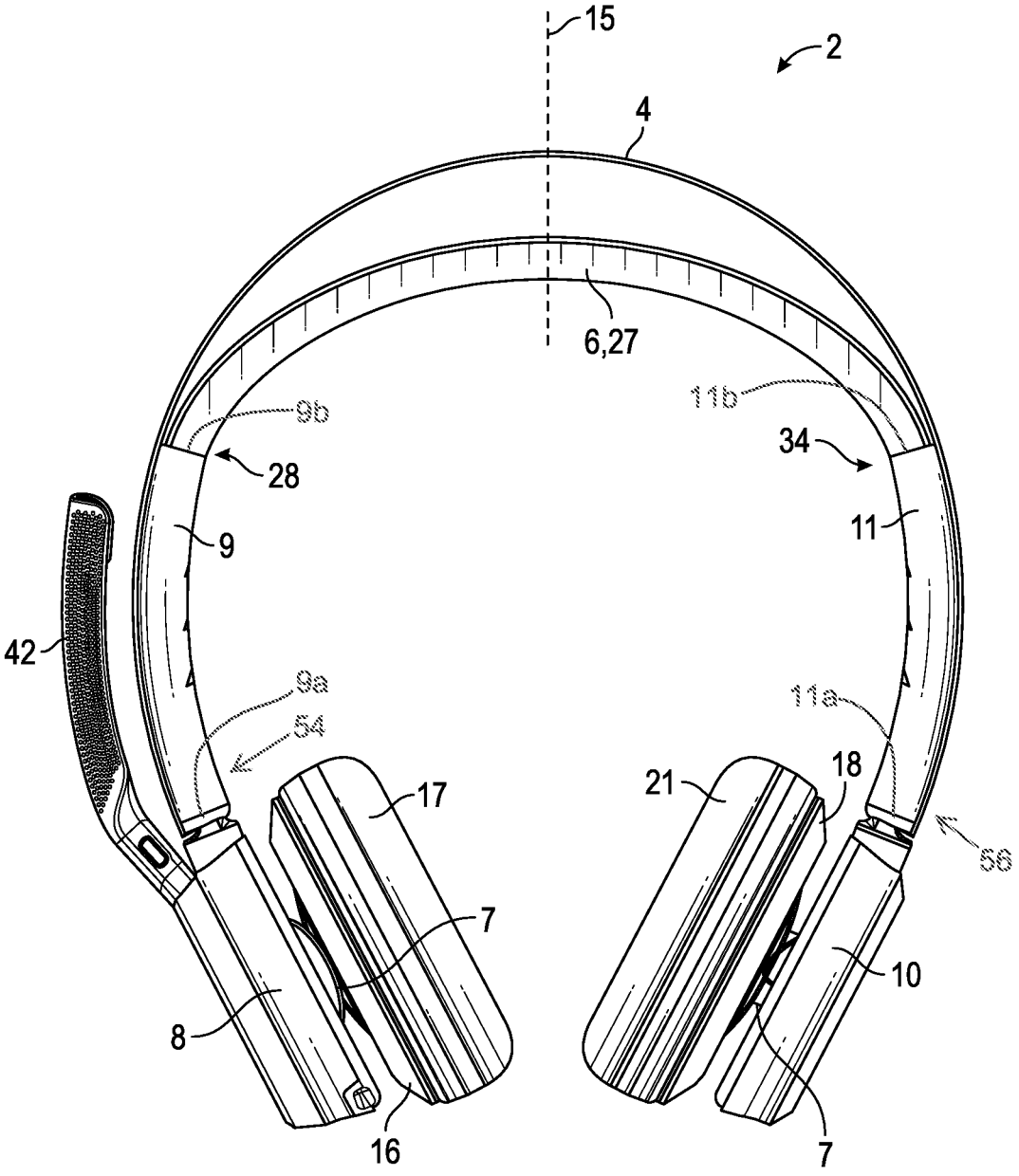
FIG. 1 shows an embodiment of a headset in a schematic front view.

Specific embodiments of the invention are here described in detail, below. In the following description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the following explanation of the present invention according to the embodiments described, the terms "coupled (to/with)" and "connected (to/with)" are used to indicate a physical connection between at least two parts, components, or objects. Such a connection may be direct between the respective parts, components, or objects; or indirect, i.e., over intermediate parts, components, or objects. It is noted that the above terms may also be used in an electrical or communication context herein. In such cases, the terms may relate to an electrical (conductive) connection, or a wire-based or wireless data and/or audio connection.

In the following description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named elements. For example, a first element is distinct from a second element, and the first element may encompass more than one element and succeed (or precede) the second element in an ordering of elements.

In light of increasing use of headsets in a variety of contexts, the inventors have ascertained that comfort, fit, and stability may be considerable design parameters of headsets. In some embodiments, the headsets described herein provide an outer headband that movably/adjustably extends between a left earphone assembly and a right earphone assembly. An inner headband, also referred to as a 'sling' herein, is provided on an interior facing side of the outer headband.

In the context of this application, the term "headset" refers to all types of headsets, headphones, and other head worn audio playback devices, such as for example circum-aural and supra-aural headphones, ear buds, in ear headphones, and other types of earphones. The headset may be of mono, stereo, or multichannel setup. A dedicated microphone for recording the user's voice may or may not be provided as part of a headset in the context of this explanation. The headset in some embodiments may comprise an audio processor. The audio processor may be of any suitable type to provide output audio from an input audio signal. For example, the audio processor may be a digital sound processor (DSP). The headset may be wireless or wired, i.e., using a cable connection.

According to a first exemplary aspect, a headset is provided with: a left earphone assembly, a right earphone assembly, and a headband assembly having a left end movably coupled to the left earphone assembly and a right end movably coupled to the right earphone assembly.

The earphone assemblies of the present aspect may be of any suitable type to provide output audio to a user during use of the headset, i.e., when the user is wearing the headset on the user's head. The earphone assemblies in some embodiments may be of circum-aural type. The earphone assemblies in some embodiments may be of supra-aural type. Generally, and in some embodiments, at least one of the earphone assemblies comprises one or more transducers, i.e., speaker drivers or (full band) speakers. In some embodiments, at least one of the earphone assemblies furthermore comprises audio processing circuitry, such as a wireless interface, an audio processor, and/or an audio amplifier. In some embodiments, at least one of the earphone assemblies furthermore comprises a battery, a user interface, and/or one or more microphones to obtain an audio signal of the user's voice. The microphones may for example be arranged integrated with the earphone assemblies. At least one microphone may for example be arranged on a microphone boom, connected with one of the earphone assemblies or the headband assembly.

As discussed in the preceding, the headband assembly is movably coupled with the left earphone assembly and the right earphone assembly. In other words, the position of both earphone assemblies with respect to the headband assembly is adjustable. In some embodiments, the headband assembly is movably coupled with the left earphone assembly and the right earphone assembly to provide a length adjustment between a center of the headband assembly and the left earphone assembly and the right earphone assembly, respectively.

The headband assembly of the headset of the present aspect furthermore comprises: an outer headband, extending between the left end and the right end of the headband assembly, a first elongated housing, arranged on an interior facing side of the outer headband and extending from the left end of the headband assembly to a first housing inner end, a second elongated housing, arranged on the interior facing side of the outer headband and extending from the right end of the headband assembly to a second housing inner end; and an inner headband, coupled between the first housing inner end and the second housing inner end on an interior facing side of the outer headband.

As will be apparent from the preceding, the first housing, the second housing, and the inner headband are arranged on an interior facing side of the outer headband. In the context of the present teachings, the term 'interior facing side' is understood as a side that, during use, i.e., when a user wears the headset on their head, faces the head of the user. In some embodiments, the outer headband is arranged as an outermost component of the headband assembly, i.e., forms a partial circumference of the other components of the headband assembly. In some embodiments, the outer headband may be arc-shaped.

The first and second elongated housing may be of any suitable type. As mentioned, the first elongated housing extends on the interior facing side of the outer headband from the left end of the headband assembly to the first housing inner end, i.e., along the longitudinal axis of the first elongated housing. Similarly, the second elongated housing extends on the interior facing side of the outer headband from the right end of the headband assembly to the second housing inner end, i.e., along the longitudinal axis. In some embodiments, the two housings are made from plastic material. In some embodiments, the width of the two housings in a direction, perpendicular to the longitudinal axis, corresponds to the width of the outer headband in the same direction, which results in a setup with flush edges. In some embodiments, the two housings are formed substantially identical. In some embodiments, the arrangement of the two housings with respect to the outer headband is mirror-inverted with respect to a, during use, vertical axis of symmetry of the outer headband. In some embodiments, the first housing and/or the second housing comprises additional components, such as for example cable assemblies.

As discussed in the preceding, the inner headband is coupled between the first housing inner end and the second housing inner end on the interior facing side of the outer headband. The inner headband may be of any suitable type. In some embodiments, the inner headband corresponds to a 'sling'. In some embodiment, the inner headband is movably and/or elastically coupled between the first housing inner end and the second housing inner end on the interior facing side of the outer headband. In the present context, the term 'elastically coupled' is understood to comprise setups, in which the inner headband may move with respect to the housings and/or stretch, for example to adapt or conform to the shape of the user's head. In some embodiments, the inner headband comprises a first and a second flexible (or elastic) member, such as for example a rubber cord or band, which couple the inner headband to the first housing inner end and the second housing inner end, respectively. In some embodiments, the inner headband returns to its original position when the headset is doffed.

The corresponding 'dual adjustability' setup of the adjustable headband assembly and the adjustable inner headband provides an improved fit and comfort of the headset from small to large heads, while the outer headband, extending between the left end and the right end provides additional stability. The resulting setup allows to fit head sizes from approximately the 1st to the 99th percentile, which includes a population of users that usually is very difficult to fit.

The movable connection of the headband assembly versus the earphones may allow for 'coarse adjustment' of the headset in some embodiments, while the adjustability of the inner headband provides a 'micro adjustment' as well as the ability to conform to the user's head shape in some embodiments, which means that more of the inner headband may be touching the user's head and thus, the weight of the headset can be distributed over a larger surface area. In addition, the adjustability of the outer headband also allows a user to set the tension of the inner headband according to the user's comfort level.

In some embodiments, the first elongated housing and the second elongated housing are mounted to the interior facing side of the outer headband. For example, the housings may be mounted to the headband using adhesive or fasteners.

In some embodiments, the outer headband comprises one or more tuning openings for adapting a clamping force provided by the outer headband. As the inventors of the present teachings have ascertained, it is possible to adapt the clamping force of the outer headband to a predefined force profile using one or more tuning openings. In some embodiments, the clamping force is set to 2.5N for most users. Such tuning openings may for example be rectangular or round openings in the outer headband. In some embodiments, the openings are formed as through holes.

In some embodiments, the outer headband comprises a continuous headband bar that extends between the left end and the right end of the headband assembly. In other words, the outer headband bar extends between the two ends as a one-piece bar, which is particularly beneficial for stability. In some embodiments, the outer headband consists only of the headband bar, providing a simple and cost-efficient setup.

In some embodiments, the headband bar is sheetlike. For example, the headband bar may be formed as a thin sheetlike strip, tape, or other tuned or bent metal with spring-like performance at various opening widths. In some embodiments, the headband bar may be formed as a partial cylinder, having a partial circular shape.

In some embodiments, the headband bar is made from sheet metal, such as for example aluminum, a ferrous metals, or spring steel (painted or unpainted). In some embodiments, the headband bar comprises one or more tuning openings for adapting a clamping force provided by the outer headband, as discussed in the preceding.

In some embodiments, the headband bar is arranged as an outermost component of the headband assembly. In other words, the headband bar forms a partial circumference of the other components of the headband assembly.

In some embodiments, the first elongated housing and the second elongated housing each comprise openings at their longitudinal ends, i.e., at the left end and the first housing inner end and the right end and the second housing inner end, respectively. These openings may serve to receive adjustment arms to position the earphones and adapt the size of the headset to the user's head.

In some embodiments, the left earphone assembly comprises a phone adjustment arm and the first housing comprises a first adjustment opening at the left end of the headband assembly. In some embodiments, the first adjustment opening is configured to receive at least part of the left phone adjustment arm.

In some embodiments, the first housing comprises an (interior) adjustment mechanism that engages with the phone adjustment arm of the left earphone assembly to provide length adjustment between a center of the headband assembly and the left earphone assembly. The adjustment mechanism may provide several pre-set positions that the adjustment arm may engage with, i.e., a "snap-in" arrangement.

In some embodiments, the right earphone assembly comprises a phone adjustment arm, and the second housing comprises a first adjustment opening at the right end of the headband assembly. In some embodiments, the first adjustment opening is configured to receive at least part of the phone adjustment arm.

In some embodiments, the second housing comprises an (interior) adjustment mechanism that engages with the phone adjustment arm of the right earphone assembly to provide length adjustment between a center of the headband assembly and the right earphone assembly. The adjustment mechanism may provide several pre-set positions that the adjustment arm may engage with, i.e., a "snap-in" arrangement.

In some embodiments, both earphone assemblies comprise the phone adjustment arms according to the preceding.

In some embodiments, the inner head band comprises an (elongated) head cushion, extending from a left band end to a right band end, wherein a (surface) contour of the head cushion at the left band end substantially corresponds to a (surface) contour of the first elongated housing at the first housing inner end. This setup provides a substantially seamless surface transition at least in a retracted position of the inner headband, i.e., when the head cushion is touching the first housing.

In some embodiments, the inner head band comprises an (elongated) head cushion, extending from a left band end to a right band end, wherein a (surface) contour of the head cushion at the right band end substantially corresponds a (surface) contour of the second elongated housing at the second housing inner end. This setup provides a substantially seamless surface transition at least in a retracted position of the inner headband, i.e., when the head cushion is touching the first housing.

In some embodiments, the aforementioned embodiments are combined so that a seamless surface transition is provided on both sides of the head cushion to both housings. In some embodiments, the head cushion comprises rigid end caps at the left band end and the right band end, for example made from plastic material.

The head cushion may be of any suitable type. In some embodiments, the head cushion comprises a cover made from leather or synthetic leather. In some embodiments, the head cushion comprises an interior padding, such as provided by (memory) foam material. In some embodiments, the head cushion comprises at least a section that in a perpendicular direction, i.e., perpendicular to the longitudinal axis of the head cushion, is wider than the outer headband. For example, the head cushion in the perpendicular direction may be formed tapered with a maximum width at a center or mid-point of the headband. In some embodiments, the width of the headband in the perpendicular direction at the left band and and/or the right band end is substantially identical to the width of the outer headband. In some embodiments, the head cushion is elastic, i.e., comprises elastic material, and allows at least part of the head cushion to stretch or deform. In other words, at least part of the head cushion is configured like a rubber band. In some embodiments, the head cushion is slidably arranged on the flexible members.

In some embodiments, the inner headband or the head cushion comprises a cable assembly to electrically connect the left earphone assembly with the right earphone assembly. In some embodiments, the cable assembly is provided inside the head cushion, which protects the cable assembly from exterior influences. In some embodiments, the cable assembly is formed to allow an elastic movement, together with the head cushion.

In some embodiments, the head cushion (or the entire inner headband) is elastically movable. In some embodiments, the head cushion is biased towards a retracted position, wherein in the retracted position, the head cushion is in contact with the first housing inner end of the first elongated housing and second housing inner end of the second elongated housing. In other words, the head cushion returns to the retracted position when no force is applied to it. For example, it is possible to provide the bias by using one or more springs or by using the aforementioned elastic material.

In some embodiments, a latching mechanism is provided to latch the head cushion in the retracted position. The latch may be configured so that the latching may be disabled by application of a pulling force by the user.

In some embodiments, the inner band further comprises a left band adjustment arm and the first housing comprises a second adjustment opening at the first housing inner end. In some embodiments, the second adjustment opening is configured to receive at least part of the left band adjustment arm.

In some embodiments, the first housing comprises an (interior) band adjustment mechanism that engages with the left band adjustment arm to provide length adjustment between a center of the inner headband and the first housing. The adjustment mechanism may provide several pre-set positions that the adjustment arm may engage with, i.e., a "snap-in" arrangement.

In some embodiments, the inner band further comprises a right band adjustment arm and the second housing comprises a second adjustment opening at the second housing inner end. In some embodiments, the second adjustment opening is configured to receive at least part of the right band adjustment arm.

In some embodiments, the second housing comprises an (interior) band adjustment mechanism that engages with the right band adjustment arm to provide length adjustment between a center of the inner headband and the second housing. The adjustment mechanism may provide several pre-set positions that the adjustment arm may engage with, i.e., a "snap-in" arrangement.

In some embodiments, one or more of the band adjustment mechanisms may be configured to provide at least a retracted position for the inner headband, wherein in the retracted position, the inner headband is biased against movement versus the first housing. In other words, some force is needed to move the inner headband out of the retracted position.

In some embodiments, the inner band further comprises both, the right band adjustment arm and the left band adjustment arm according to the preceding.

In some embodiments, the inner headband is configured as described in U.S. Pat. No. 9,980,048 B2 (Application U.S. Ser. No. 16/600,711), the contents of which are incorporated herein for all purposes.

In some embodiments, the headset further comprises a microphone boom, connected to one of the left earphone assembly and the right earphone assembly, wherein the microphone boom comprises at least one microphone.

According to a second exemplary aspect, a headset is provided that comprises a left earphone assembly, a right earphone assembly, and a headband assembly having a left end movably coupled to the left earphone assembly and a right end movably coupled to the right earphone assembly. In some embodiments, he headband assembly comprises an outer headband, extending between the left end and the right end of the headband assembly, a first housing, extending from the left end of the headband assembly to a first housing inner end, a second housing, extending from the right end of the headband assembly to a second housing inner end, and an inner headband, coupled between the first housing inner end and the second housing inner end. In some embodiments, the inner headband extends from a left band end to a right band end, wherein a contour of the inner headband at the left band end substantially corresponds to a contour of the first housing at the first housing inner end and a contour of the inner headband at the right band end substantially corresponds a contour of the second housing at the second housing inner end.

In some embodiments, the first housing, the second housing, and the inner headband are arranged on an interior facing side of the outer headband.

In some embodiments, the headset according to the present exemplary aspect is configured according to one or more of the embodiments of the headset according to the first exemplary aspect.

Reference will now be made to the drawings in which the various elements of embodiments will be given numerical designations and in which further embodiments will be discussed.

In the exemplary embodiments, the described components of the embodiments each represent individual features that are to be considered independent of one another, in the combination as shown or described, and in combinations other than shown or described. In addition, the described embodiments can also be supplemented by features of the invention other than those described.

Figure 2:
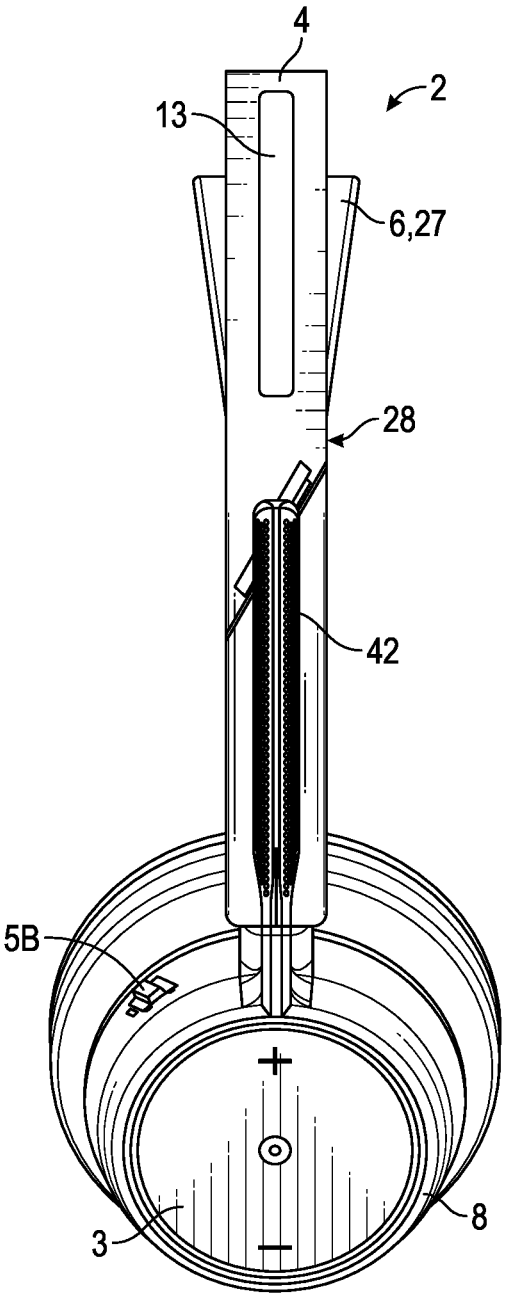
FIG. 2 shows a schematic side view of the embodiment of the headset of FIG. 1.
Figure 3:
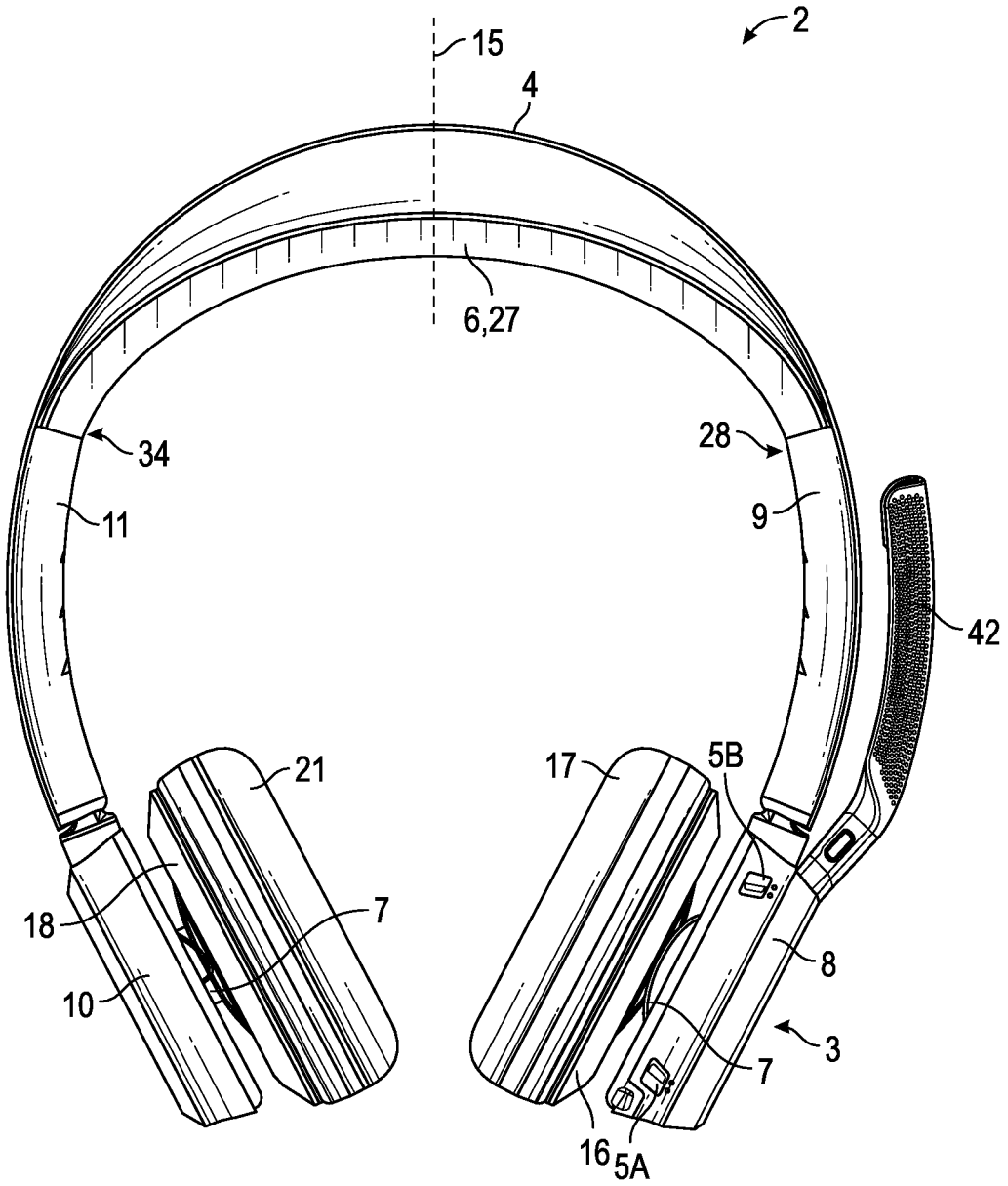
FIG. 3 shows a schematic back view of the embodiment of the headset shown in FIG. 1.
Figure 4:
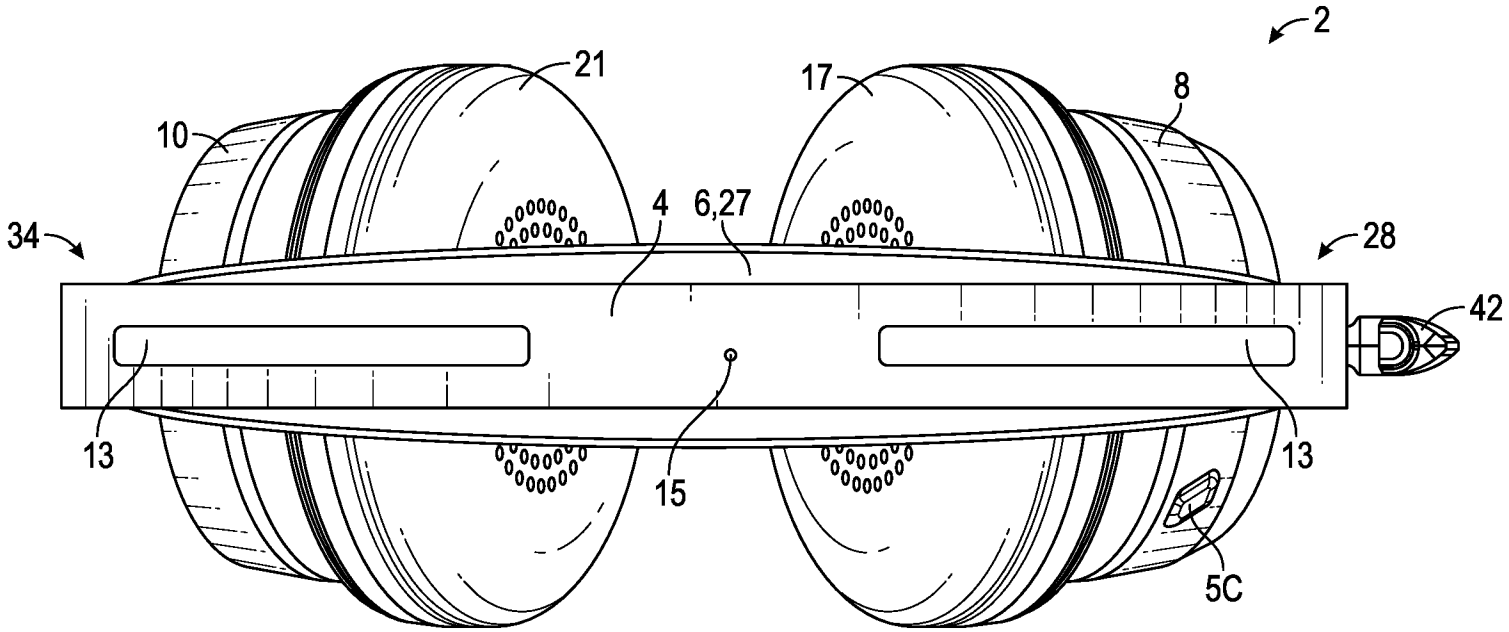
FIG. 4 shows a schematic top view of the embodiment of the headset shown in FIG. 1.
Figure 5:
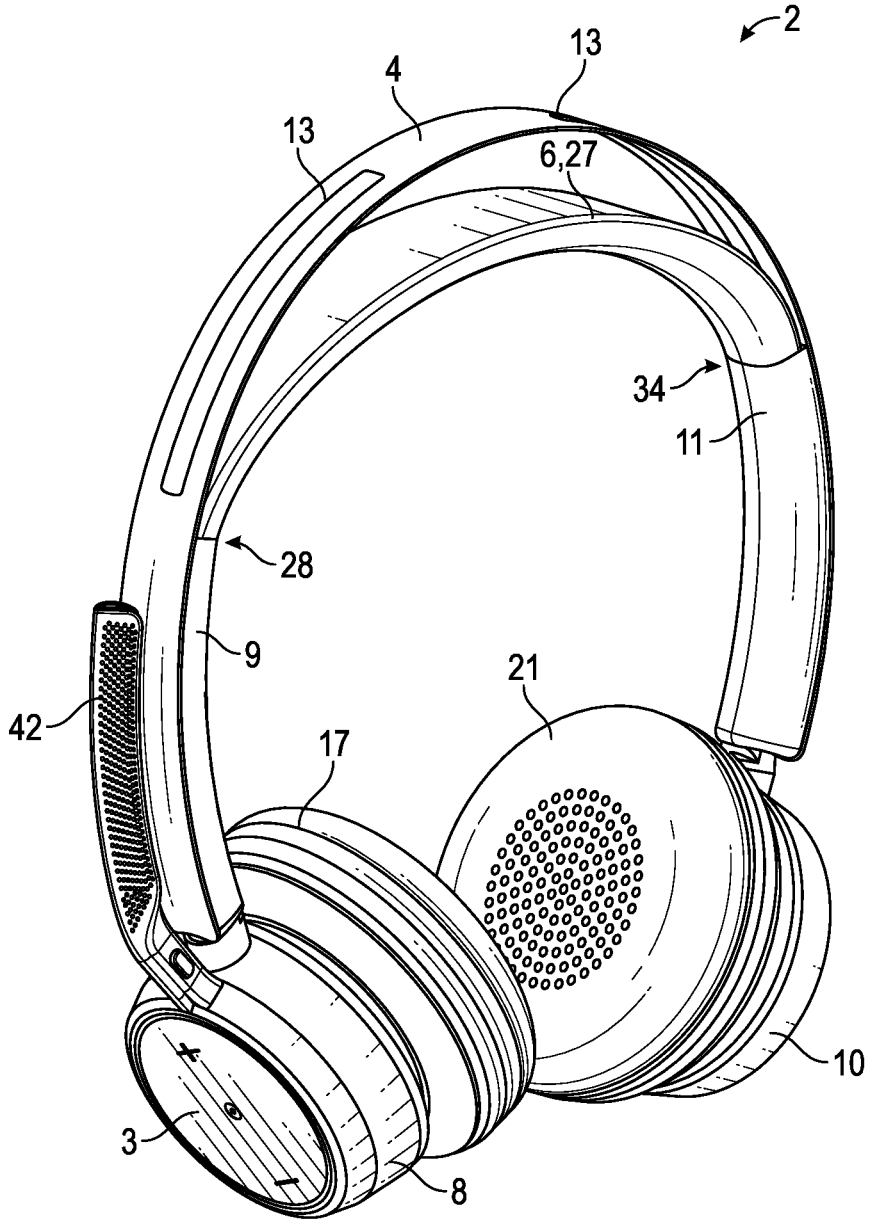
FIG. 5 shows a schematic perspective view of the embodiment of the headset shown in FIG. 1.

FIG. 1 shows a schematic front view of a headset 2 according to an embodiment. FIG. 2 illustrates a schematic side view of the headset 2 shown in FIG. 1, while FIG. 3 shows a schematic back view of the headset 2. FIG. 4 shows a schematic top view of the headset 2 and FIG. 5 shows a schematic perspective view of the headset 2.

Headset 2 includes a left earphone assembly 8, right earphone assembly 10, outer headband 4, an inner headband 6, a first elongated housing 9, and a second elongated housing 11. Headset 2 further includes microphone boom 42 having multiple microphones (not shown). Both headbands 4, 6 have an arcuate shape.

The left earphone assembly 8 comprises a speaker housing 16 with a speaker driver 45 (see FIG. 6) and an ear cushion 17. Similarly, the right earphone assembly 10 comprises a speaker housing 18, a speaker driver 46, and an ear cushion 21. Each ear cushion operates both to provide comfort as well as serve the purpose of sealing around the user's ear to keep in sound reproduced by speaker drivers 45, 46. The shown left earphone assembly 8 and right earphone assembly 10 are merely one example among many which can be used with the headset 2.

Ball joints (ball-and-socket type joints) 7 are provided between the speaker housings 16, 18 and the remainder of the respective earphone assembly 8, 10 to allow adjusting the position of the speaker housings 16, 18 on the user's ears when wearing the headset 2. The joints provide the ability for angular motion in all directions, thereby enabling them to adjust to any ear shape when placed on the user's ear. In a further embodiment, a yoke style arrangement may be used.

Headset 2 according to the present embodiment is a wireless headset.

Accordingly, the headset comprises a wireless interface (e.g., a Bluetooth interface), control electronics, and an amplifier (all not shown) which are arranged in the left earphone assembly 8. A battery (not shown) is provided in the right earphone assembly 10 to power all components of the headset.

Left earphone assembly 8 further comprises a user interface 3 (volume up/down, multifunction: call answer/end), provided on an outer end of the left earphone assembly 8, as can be seen from FIG. 2. Additional controls 5, namely power/pairing button 5A, mute button 5B, and noise cancellation control button 5C, are provided on the left earphone assembly 8, as can be seen from FIGS. 3 and 4.

The outer headband 4 is formed by a continuous (one piece) headband bar made from sheet metal, e.g., Stainless Steel SUS301 3/4H. The outer headband 4 comprises multiple tuning openings 13 (see FIGS. 4 and 5) that provide an adapted clamping force and improves the wearing comfort of headset 2. As follows in particular from FIGS. 1, 3, and 5, the continuous outer headband 4 is arranged on a circumference of the two housings 9, 11 and the inner headband 6. This arrangement provides stability while wearing the headset 2, but also while handling and storing. It is noted that the outer headband 4 is fixed relative to the two housings 9, 11, i.e., does not provide adjustability.

The first elongated housing 9 and the second elongated housing 11 are mounted to an interior facing side of the outer headband 4, i.e., the side that during wearing of the headset 2, faces the user's head. As shown in FIG. 1, the first elongated housing 9 extends from a first housing outer end 9*a* secured at a left end 54 of the headband assembly 2 to a first housing inner end 9*b*, and the second elongated housing 11 extends from a second housing outer end 11*a* secured at a right end 56 of the headband assembly 2 to a second housing inner end 11*b*. The two housings 9, 11 comprise adjustment mechanisms 12, 14 to provide for vertical length adjustment between a center axis 15 (i.e., the top) of outer band 4 and the earcup assemblies 8, 10.

Figure 6:
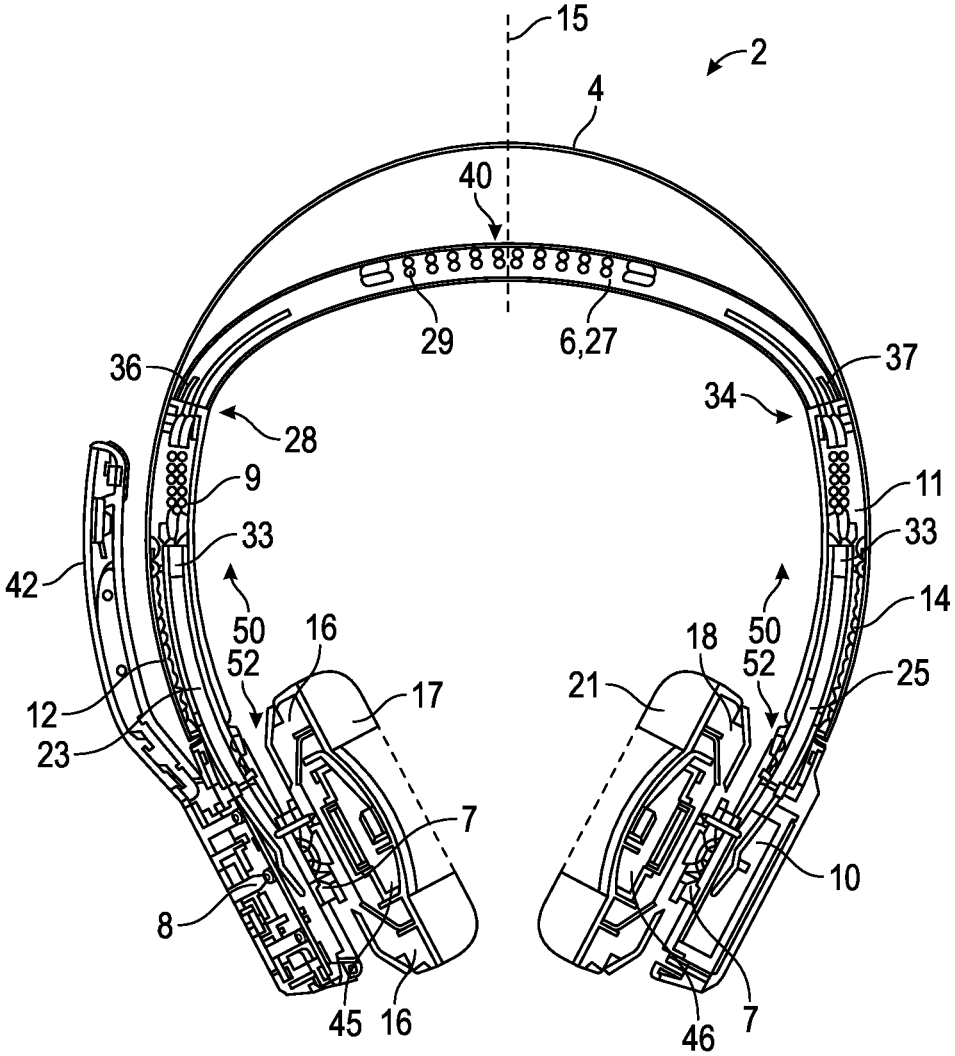
FIG. 6 shows a schematic cross-section view of the embodiment of the headset shown in FIG. 1.

The details of the length adjustment will be discussed in the following with reference to FIG. 6, which shows a cross-sectional view of headset 2.

The adjustment mechanism 12 of the first housing 9 comprises multiple detents and movably mates with a phone adjustment arm 23 of the left earphone assembly 8.

In operation, left earphone assembly 8 is capable of movement in a direction 50 towards the center 15 of outer band 4 until left earphone assembly 8 reaches a fully retracted position, which is shown in FIGS. 1-6.

Figure 8:
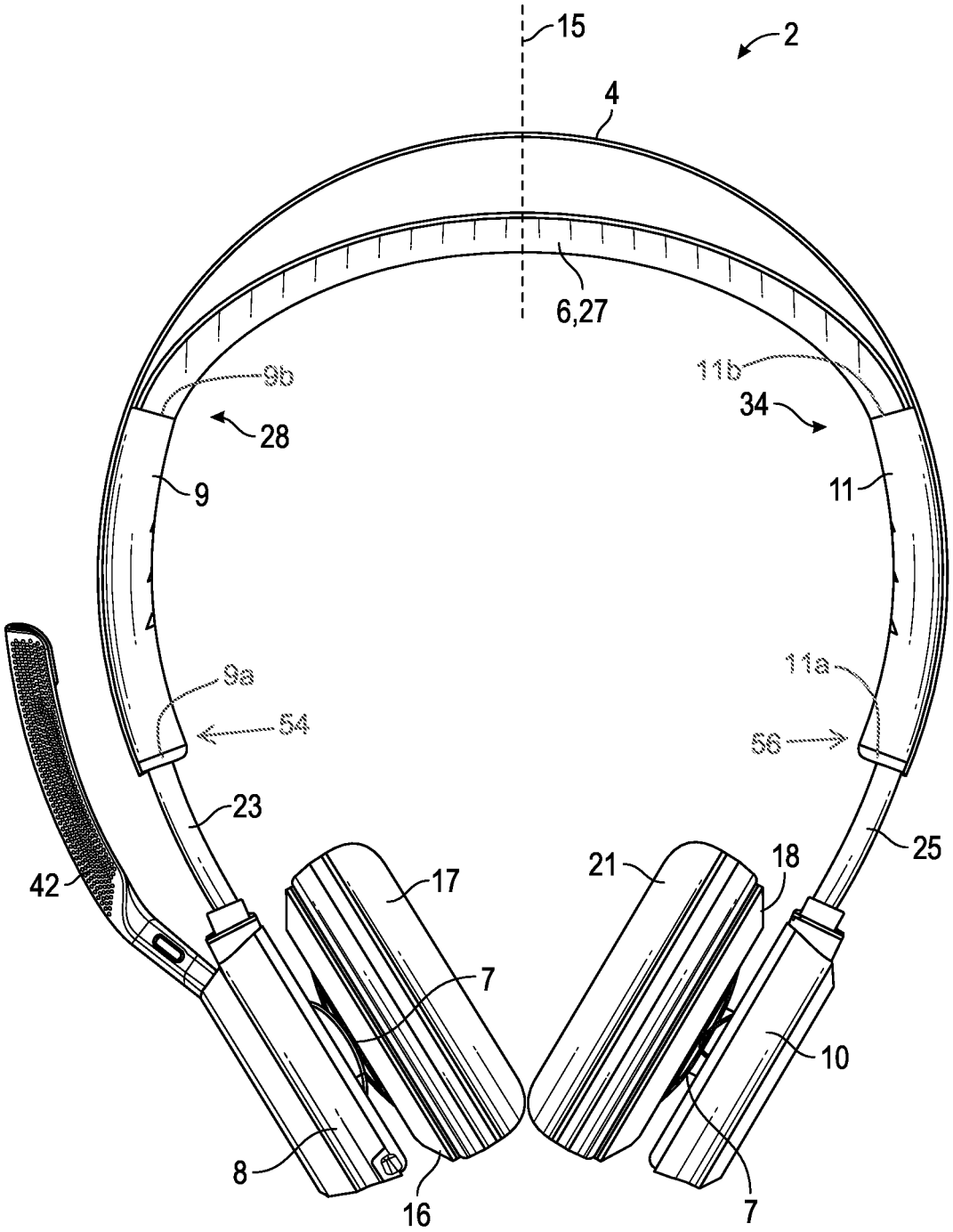
FIG. 8 shows a schematic front view of the headset shown in FIG. 1 in a fully extended position of earphones.

Left earphone assembly 8 is also capable of movement in a direction 52 away from the center 15 of outer band 4 until left earphone assembly 8 reaches a fully extended position, which is shown in FIG. 8.

As left earphone assembly 8 is moved towards the center 15 of outer band 4, the phone adjustment arm 23 is inserted further the first housing 9 and as earphone assembly 8 is moved away from the center 15 of outer band 4, the phone adjustment arm 23 is moved in a withdrawal direction from the first housing 9.

Corresponding to the preceding, the adjustment mechanism 14 of the second housing 11 comprises multiple detents and movably mates with a phone adjustment arm 25 of the right earphone assembly 10.

In operation, right earphone assembly 10 is capable of movement in a direction 50 towards the center 15 of outer band 4 until right earphone assembly 10 reaches a fully retracted position, which is shown in FIGS. 1-6. Right earphone assembly 10 is also capable of movement in a direction 52 away from the center 15 of outer band 4 until the right earphone assembly 10 reaches a fully extended position, shown in FIG. 8.

As follows from FIG. 6, the operation of the two adjustment mechanisms 12, 14 basically corresponds to each other. It is noted that in some embodiments, only one of the two earphones 8, 10 may be adjustable.

Figure 9:
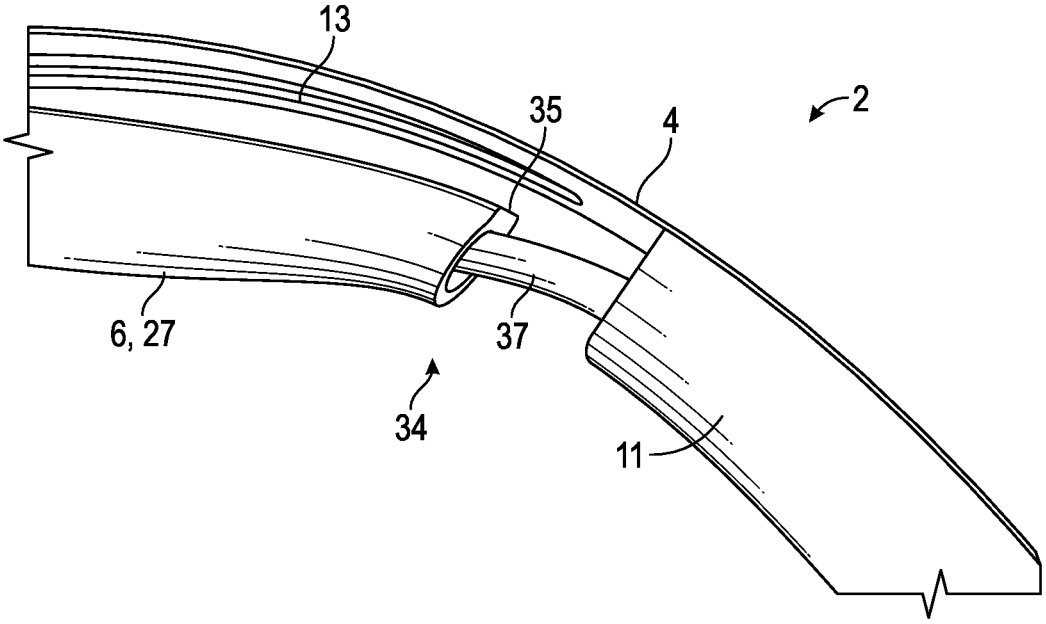
FIG. 9 shows a partial front view of the headset shown in FIG. 1 with an inner headband in a maximum extended position.

Inner headband 6, also referred to as 'sling' herein, comprises a head cushion 27 that extends from a left band end 28 to a right band end 34. At the left band end 28 and the right band end 34, the head cushion 27 comprises end caps 35 (see FIG. 9) made from plastic material.

The shape of the end surfaces of the end caps at the left and right band ends 28, 34, i.e., at the longitudinally opposing ends, corresponds to the shape of the end surfaces of the first and second housing 9, 11, so that in a retracted position of FIGS. 1-6, a seamless surface transition between the head cushion 27 and the first and second housings 9, 11 is given.

As will be particularly apparent from FIG. 2 and FIG. 4, the head cushion 27 is tapered and has a maximum width at the center 15 of outer band 4. As can be seen from FIG. 2 and FIG. 4, the head cushion 27 at the center 15 is wider than outer band 4, while at the left and right band ends 28, 34, the width of the head cushion 27 corresponds to the width of outer band 4. The configuration of head cushion 27 provides improved stability.

The inner headband 6 comprises a first flexible member 36 and a second flexible member 37. The head cushion 27 comprises elastic material (not shown) and can be elastically moved between the mentioned retracted position to a maximum extended position, the latter of which is shown in the partial front view of FIG. 9 and in FIG. 10. The elastic material is pulled/lengthened when the headband is placed on the user's head, exerting tension, and returns to its former shape/length/position when removed from the user's head. In one example, elastic material is an elastomer having highly elastic properties. In one example, the elastic material is a woven elastic fabric or rubber band having a length of 20-70 millimeters and a stretch capability of 30%415%. In a further example, the elastic material may be a spiral wound plastic spring or metal spring.

The elastic material is disposed between sheet plastic (not shown). A sleeve (not shown) made from synthetic leather (not shown) is provided on the outside of head cushion 27. The elastic material allows the head cushion 27 to slide over the two flexible members 36, 37 when deformed, e.g., by the user's head.

Figure 7B:
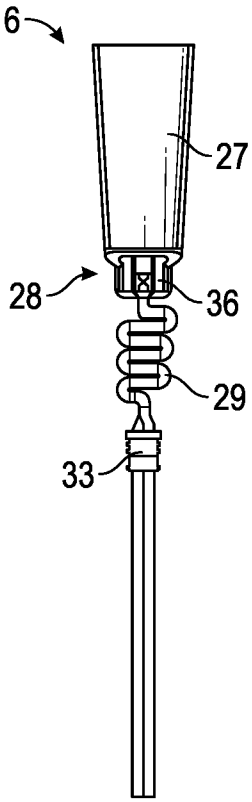
FIGS. 7A and 7B show views of a sub assembly of an inner headband with a cable assembly of the embodiment of the headset shown in FIG. 1
Figure 7A:
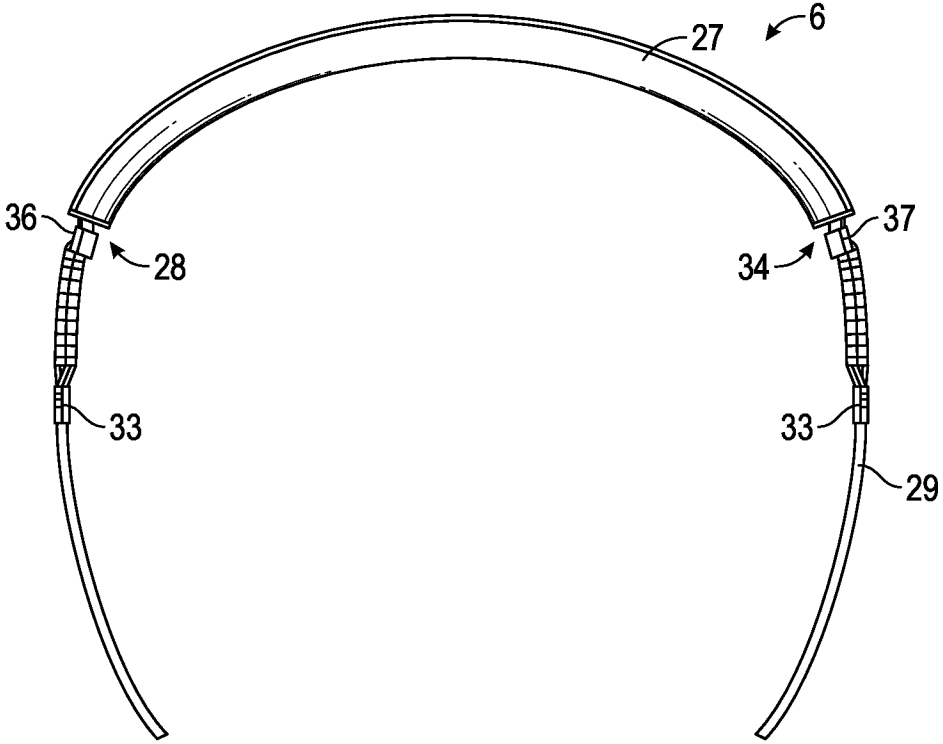
Figure 10:
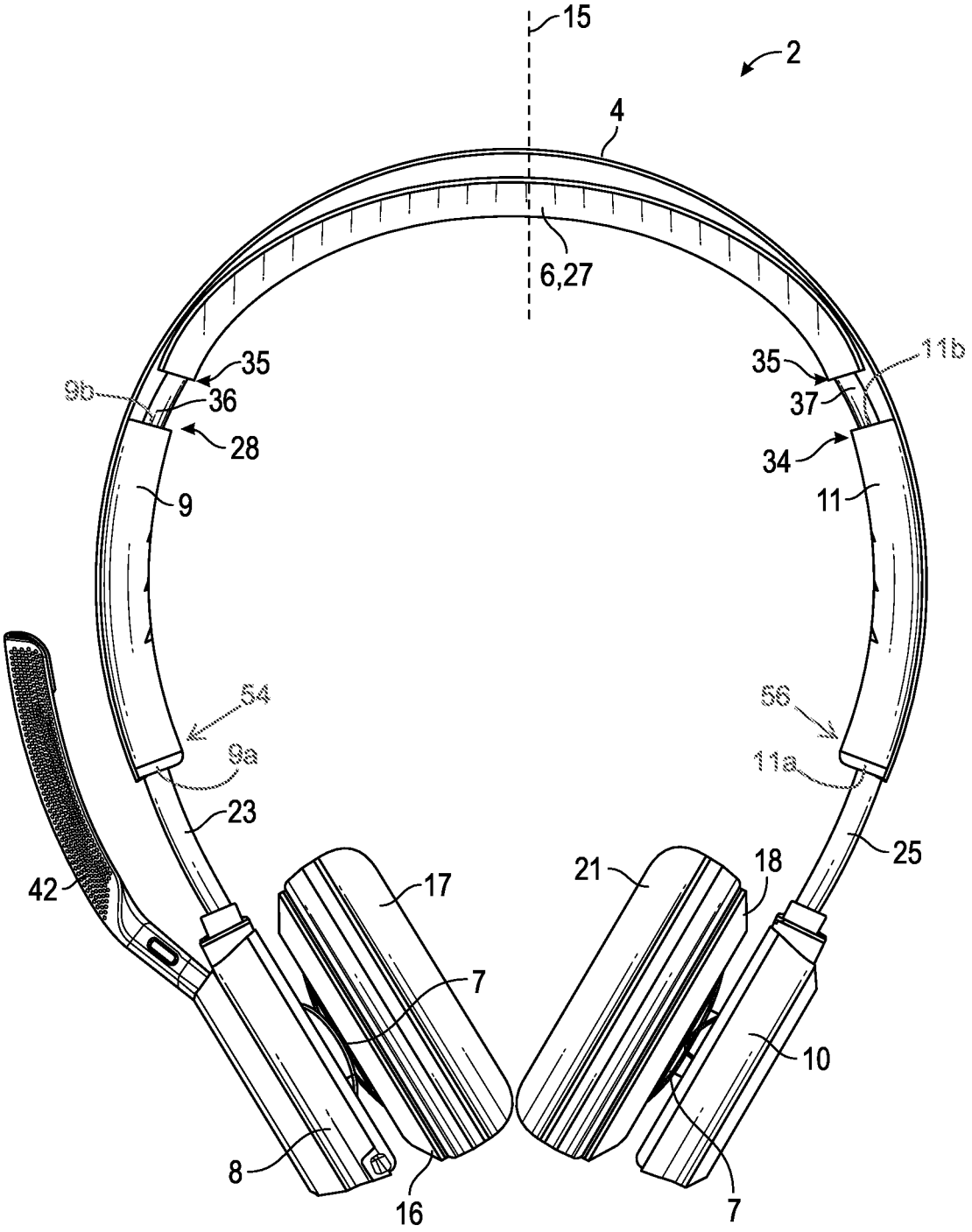
FIG. 10 shows a front view of headset 2 with the inner headband in the maximum extended position.

The head cushion 27 furthermore comprises a coiled cable assembly 29 that connects the left earphone assembly 8 with the right earphone assembly 10. The cable assembly 29 carries power, data/controls and audio. FIGS. 7A and 7B show views of the sub assembly of inner headband 6 with the cable assembly 29. As can be seen from FIGS. 7A and 7B., the cable assembly 29 comprises two coiled or 'wound-up' sections that allow the cable assembly 29 to stretch with the rest of inner headband 6. As can be seen from FIG. 6, the two coiled sections are located inside of the first and second housings 9, 11, respectively. Two strain relief blocks 33 are provided as part of the cable assembly 29, which are attached to the respective housing 9, 11. A third coiled section 40 is located in the middle of head cushion 27, as can be seen from FIG. 6. Due to this setup, the cable assembly 29 and the elastic material act in parallel to provide a total combined elastic behavior of the inner headband 6. FIG. 10 shows a front view of headset 2 with the inner headband 6 in the maximum extended position.

In operation, the inner headband 6 is positioned on the user's head when the user puts on the headset 2. The elasticity of inner headband 6 allows it to self-adapt (i.e., automatically conform) to the user's head, accommodating a variety of head sizes. In addition to altering in length to ensure a proper fit, the inner headband 6 provides a resilient inner force against the user head to hold the headset 2 securely in place, the resilient inner force in response to the elastic material being stretched upwards (i.e., outwards). The head cushion 27 rests against the user's head. In one example, the head cushion 27 includes a base material of foam padding with an outer covering surface such as leather.

The self-adjustment of the inner headband 6 provides for a precise, elastic fit. The manual, 'coarse' adjustment of the two earphones 8, 10 provides for a wide range of motion, accommodating a wide range of head sizes. The setup thus utilizes manual adjustment in combination with self-adjustment, resulting in an unparalleled precise fit, comfort, and flexibility in accommodating a diversity of wearer head sizes. The headset has multiple ideal settings in which it can be worn, which are fully adjustable by the user. The user can determine if they prefer a snugger/more stable fit by utilizing more elastic deformation of the inner headband 6 and less extension on the earphones 8, 10, or alternatively a looser/lighter fit by utilizing more extension on the earphones 8, 10 and pressure of inner headband 6.

In some embodiments, the inner headband is configured as described in U.S. Pat. No. 9,980,048 B2 (application U.S. Ser. No. 16/600,711), the contents of which are incorporated herein for all purposes.

The invention has been described in the preceding using various exemplary embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module or other unit or device may fulfil the functions of several items recited in the claims.

The term "exemplary" used throughout the specification means "serving as an example, instance, or exemplification" and does not mean "preferred" or "having advantages" over other embodiments.

The mere fact that certain measures are recited in mutually different dependent claims or embodiments does not indicate that a combination of these measures cannot be used to advantage. Any reference signs in the claims should not be construed as limiting the scope.

What is claimed is:

1. A headset comprising:

a left earphone assembly;

a right earphone assembly;

a headband assembly extending from a left end near the left earphone assembly to a right end near the right earphone assembly, the headband assembly comprising:

an outer headband, extending between the left end and the right end of the headband assembly;

a first elongated housing, arranged on an interior facing side of the outer headband and extending from a first housing outer end secured at the left end of the headband assembly to a first housing inner end;

a second elongated housing, arranged on the interior facing side of the outer headband and extending from a second housing outer end secured at the right end of the headband assembly to a second housing inner end; and an inner headband extending from a first band end to a second band end, the inner headband coupled between the first housing inner end and the second housing inner end on the interior facing side of the outer headband;

wherein the inner headband is movably coupled to the first elongated housing to adjust a distance between the first band end of the inner headband and the first housing inner end of the first elongated housing; and wherein the left earphone assembly is movably coupled to the first elongated housing to adjust a distance between the left earphone assembly and the first housing outer end of the first elongated housing.

2. The headset of claim 1, wherein the first elongated housing and the second elongated housing are mounted to the interior facing side of the outer headband.

3. The headset of claim 1, wherein the outer headband comprises one or more tuning openings for adapting a clamping force provided by the outer headband.

4. The headset of claim 1, wherein the outer headband comprises a continuous headband bar that extends between the left end and the right end of the headband assembly.

5. The headset of claim 4, wherein the headband bar is formed from sheet metal.

6. The headset of claim 4, wherein the headband bar comprises one or more tuning openings for adapting a clamping force provided by the outer headband.

7. The headset of claim 4, wherein the headband bar is arranged as an outermost component of the headband assembly.

8. The headset of claim 1, wherein the left earphone assembly comprises a phone adjustment arm; and the first elongated housing comprises a first adjustment opening at the left end of the headband assembly;

wherein the first adjustment opening is configured to receive at least part of the left phone adjustment arm.

9. The headset of claim 8, wherein the first elongated housing comprises an adjustment mechanism that engages with the phone adjustment arm of the left earphone assembly to adjust the distance between the left earphone assembly and the first housing outer end of the first elongated housing.

10. The headset of claim 1, wherein the inner headband is elastically coupled between the first housing inner end and the second housing inner end, wherein the headset comprises an elastic member connected between the first elongated housing and the inner headband to movably couple the inner headband to the second elongated housing to adjust the distance between the first band end of the inner headband and the first housing inner end of the first elongated housing;

wherein the flexible extendable member biases the first band end of the inner headband to a retracted position relative to the first housing inner end of the first elongated housing.

11. The headset of claim 1, wherein the inner headband comprises a head cushion, extending from the left band end to the right band end, wherein a contour of the head cushion at the left band end corresponds to a contour of the first elongated housing at the first housing inner end.

12. The headset of claim 1, wherein the inner headband comprises a head cushion, extending from the left band end to the right band end, wherein a contour of the head cushion at the right band end corresponds to a contour of the second elongated housing at the second housing inner end.

13. The headset of claim 1, wherein the inner headband comprises an elastically movable head cushion.

14. The headset of claim 13, wherein the head cushion is biased towards a retracted position, wherein in the retracted position, the head cushion is in contact with the first housing inner end of the first elongated housing and second housing inner end of the second elongated housing.

15. The headset of claim 1, further comprising a microphone boom, connected to one of the left earphone assembly and the right earphone assembly, wherein the microphone boom comprises at least one microphone.

16. The headset of claim 1, wherein:

the inner headband is movably coupled to the second elongated housing to adjust a distance between the second band end of the inner headband and the second housing inner end of the second elongated housing; and the right earphone assembly is movably coupled to the second elongated housing to adjust a distance between the right earphone assembly and the second housing outer end of the second elongated housing.

17. The headset of claim 16, wherein the right earphone assembly comprises a phone adjustment arm; and the second elongated housing comprises a first adjustment opening at the right end of the headband assembly;

wherein the first adjustment opening is configured to receive at least part of the phone adjustment arm.

18. The headset of claim 17, wherein the second elongated housing comprises an adjustment mechanism that engages with the phone adjustment arm of the right earphone assembly to adjust the distance between the right earphone assembly and the second housing outer end of the second elongated housing.

19. A headset comprising:

a left earphone assembly;

a right earphone assembly;

a headband assembly having a left end movably coupled to the left earphone assembly and a right end movably coupled to the right earphone assembly, the headband assembly comprising:

an outer headband, extending between the left end and the right end of the headband assembly;

a first elongated housing, extending from the left end of the headband assembly to a first housing inner end;

a second elongated housing, extending from the right end of the headband assembly to a second housing inner end; and an inner headband, coupled between the first housing inner end and the second housing inner end; wherein the inner headband extends from a left band end to a right band end; and wherein a surface contour of the inner headband at the left band end matches a surface contour of the first elongated housing at the first housing inner end and a surface contour of the inner headband at the right band end matches a contour of the second elongated housing at the second housing inner end, to provide a continuous surface transition between the inner headband and the first elongated housing and second elongated housing in a retracted position of the inner headband.

20. The headset of claim 19, wherein the first elongated housing, the second elongated housing, and the inner headband are arranged on an interior facing side of the outer headband.

* * * * *